United States Patent [19]

Halmos

[11] 4,430,040

[45] Feb. 7, 1984

[54] COIL UPENDER

[76] Inventor: George G. Halmos, 81 Munro Blvd., Willowdale, Ontario, Canada, M2P 1C5

[21] Appl. No.: 330,037

[22] Filed: Dec. 14, 1981

[51] Int. Cl.[3] ..... B66C 1/54

[52] U.S. Cl. ..... 414/783; 294/103 CG; 414/620; 414/622; 414/626; 414/911

[58] Field of Search ..... 414/618, 619, 620, 621, 414/622, 626, 684, 754, 783, 908, 910, 911; 294/67 A, 67 AA, 67 AB, 67 BB, 67 R, 103 R, 103 CG

[56] References Cited

U.S. PATENT DOCUMENTS

| | | | |
|---|---|---|---|
| 2,630,931 | 3/1953 | Douglas | 414/908 X |
| 2,699,880 | 1/1955 | Haehn et al. | 414/622 |
| 2,714,969 | 8/1955 | Bartel et al. | 294/103 X |
| 2,770,380 | 11/1956 | Anderson | 414/626 |
| 2,945,609 | 7/1960 | Benes et al. | 294/103 CG |
| 2,972,427 | 2/1961 | Quayle | 414/620 |
| 2,981,429 | 4/1961 | Williamson | 414/622 |
| 3,734,328 | 5/1973 | Dalglish | 414/684 X |
| 4,154,470 | 5/1979 | Dalglish | 414/684 X |

FOREIGN PATENT DOCUMENTS

| | | | |
|---|---|---|---|
| 714482 | 9/1954 | United Kingdom | 414/622 |

*Primary Examiner*—Leslie J. Paperner
*Attorney, Agent, or Firm*—Sim & McBurney

[57] ABSTRACT

There is provided a coil upending and transporting apparatus which includes a main frame having means for allowing the frame to be suspended from a suspension means, and a sub-frame pivoted to the main frame at a horizontal axis located below the suspension means. Power means such as hydraulic cylinders are provided for positively pivoting the sub-frame with respect to the main frame about the axis. The sub-frame includes support means for engagement under a coil whose axis is vertical, and an elongate holding mandrel disposed so as to be parallel with the axis of a coil at one end of which the support means is engaged. Control means are also provided for moving the holding mandrel selectively (1) in the direction of its elongation, and (2) perpendicular to both its own elongation direction and the direction of said horizontal axis.

4 Claims, 14 Drawing Figures

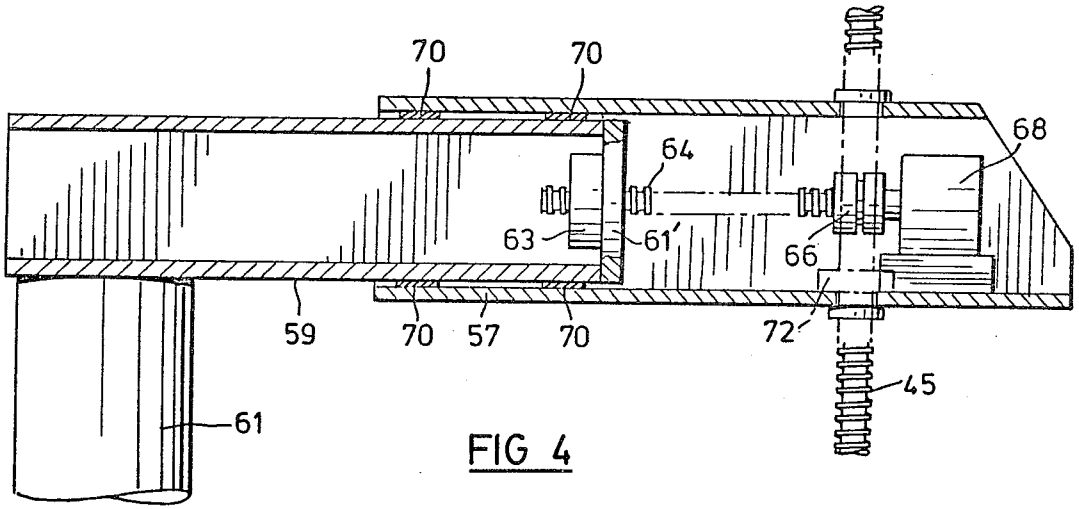
FIG 4
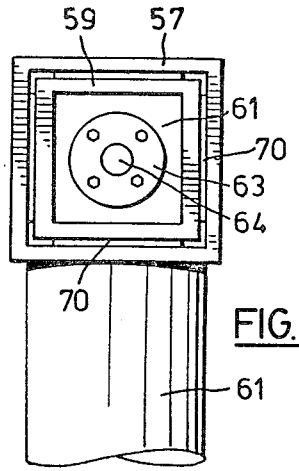
FIG. 5
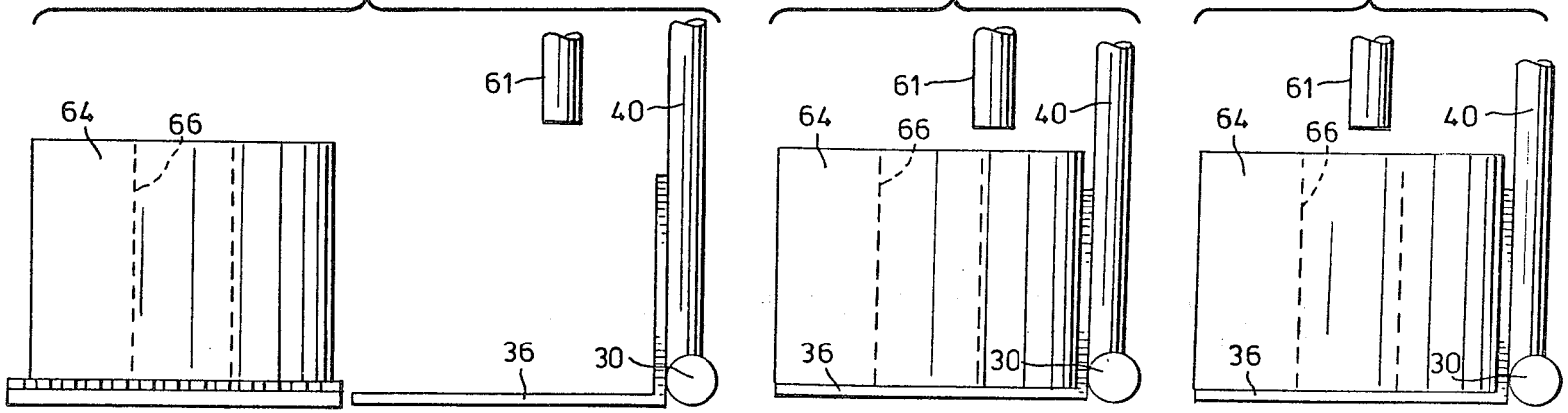
FIG. 3A
FIG. 3B
FIG. 3C

COIL UPENDER

This invention relates generally to apparatus for rotating products, in particular such heavy products as steel coils.

GENERAL BACKGROUND OF THIS INVENTION

In the past, apparatus designed to upend steel coils and other heavy items have tended to be expensive and bulky. This was partly due to the fact that considerable power was required for the upending operation, along with heavily constructed supporting structure.

One approach that has been taken to the problem of upending steel coils and the like is exemplified in U.S. Pat. No. 3,395,813, issued Aug. 6, 1968, entitled "APPARATUS FOR TURNING PRODUCTS", Bruce and Nelson. In this patent, an apparatus is disclosed in which the weight of the coil or other similar products is used to supply the force needed for the turning operation, whereby no other source of power is required for turning the products or for returning the apparatus to its original position after the product is turned. The apparatus of U.S. Pat. No. 3,395,813, however, is intended to be mounted in place and immovable. Hence, its considerable bulk is not a problem. However, the apparatus of the Bruce et al patent is not capable of performing any additional operations. For example, the apparatus is incapable of picking up a coil and moving it from one location in a plant to another, with the option of rotating the coil during the transportation.

Hence, the Bruce et al patent is exemplary of the prior art apparatus used in the conventional method of handling coils. Typically, the coils are shipped with the axis vertical, and are removed from the transport vehicle (normally trucks) with a forked attachment suspended on a crane. This attachment moves the coil to a stationary coil upender, and up upending, the coils are normally moved to storage or to the coil processing equipment with another crane attachment. In view of the foregoing, it would be of advantage to be able to eliminate transportation to and from a stationary coil upender, as well as eliminating the change of crane attachment.

GENERAL DESCRIPTION OF THIS INVENTION

It is an object of an aspect of this invention to provide a coil upending and transporting apparatus adapted to be suspended from an overhead crane or other material handling/lifting device, and which is capable of picking up a metal coil, whether standing upright or lying on its side, of transporting the coil from one place to another, and of rotating the coil between two positions at 90°, in either direction.

More particularly, this invention provides a coil upending and transporting apparatus which comprises a main frame having means for allowing the frame to be suspended from a crane, and a sub-frame pivoted to the main frame at a horizontal axis located below the means for suspension. Power means are provided for positively pivoting the sub-frame with respect to the main frame about the axis. The sub-frame includes support means for engagement under a coil whose axis is vertical, and an elongate holding mandrel disposed so as to be parallel with the axis of a coil at one end of which the support means is engaged. Additionally, control means are provided for moving the holding mandrel selectively (1) in the direction of its elongation, and (2) perpendicular to both its own elongation direction and the direction of said horizontal axis.

The horizontal axis at which the sub-frame is pivoted to the main frame is substantially aligned with the centre of gravity of the sub-frame when carrying a coil of average weight and size, thus reducing the work required of the power means to positively pivot the sub-frame and coil about the horizontal axis.

GENERAL DESCRIPTION OF THE DRAWINGS

One embodiment of this invention is illustrated in the accompanying drawings, in which like numerals denote like parts throughout the several views and in which:

FIGS. 3A to 3J illustrate sequential stages in the upending of a coil with the apparatus of this invention;

FIG. 4 is a section through one portion of the apparatus, illustrating a drive mechanism; and FIG. 5 is an end view of the portion shown in FIG. 4.

DETAILED DESCRIPTION OF THE DRAWINGS

Figure 1:
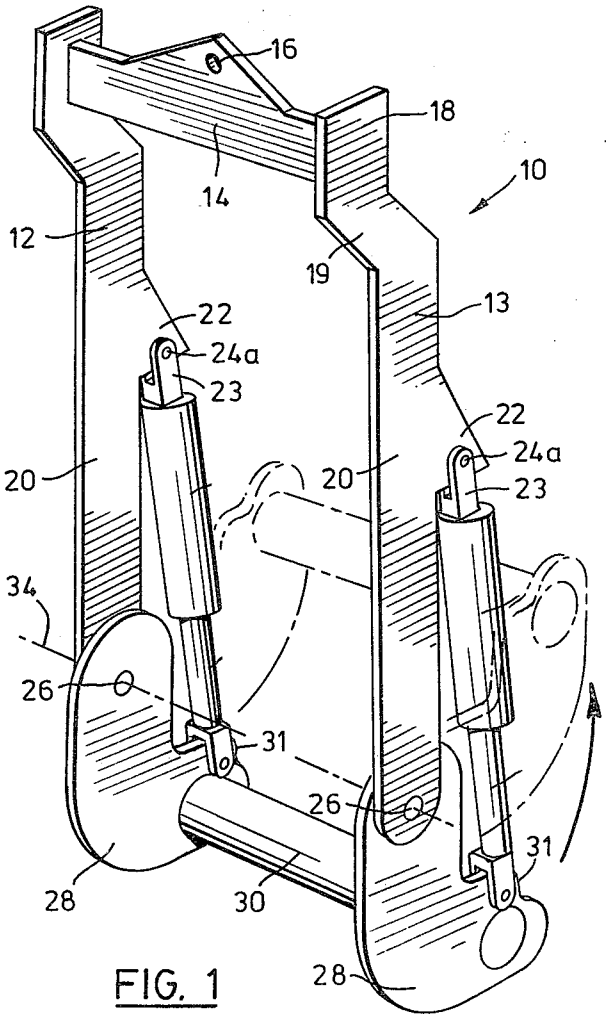
FIG. 1 is a perspective view of the main frame of the apparatus of this invention, together with a portion of the sub-frame.

Attention is first directed to FIG. 1 in which is illustrated a main frame 10 which includes two vertical spaced-apart members 12 and 13 joined together in fixed relation by an upper linking member 14. As can be seen, the upper linking member 14 has a central opening 16 for engagement by a crane or the like (not shown).

Each of the members 12 and 13 includes an upper vertical portion 18, an offset portion 19, and a lower vertical portion 20. At an intermediate location of the lower portion 20 there is an integral, rearward triangular extension 22 which provides a point of attachment for one end of a hydraulic cylinder 24. More specifically, each hydraulic cylinder 24 is pivotally connected to the extension 22 through a fork connection 23 and a pin 24*a*.

Pivotally mounted to the bottom of the portion 20 of each member 12, 13, through a pivot pin 26 is a pivot plate 28, and both pivot plates 28 are securely and fixedly joined together by a pipe 30 to which they are welded or otherwise fixed. Thus, the pivot plates 28 and the pipe 30 rotate as a unit about the pins 26.

Each of the pivot plates 28 is approximately triangular in shape with rounded corners, and on the "hypotenuse" or upper rearward portion thereof there is a protruding portion 31 to which the end of the hydraulic piston 33 is pivotally connected by the conventional connection.

Thus, retraction and extension of the hydraulic cylinders 24 will cause rotation of the pivot plates 28 in tandem about a pivot axis defined by the broken line 34 extending co-axially through the two pivot pins 26.

Figure 2:
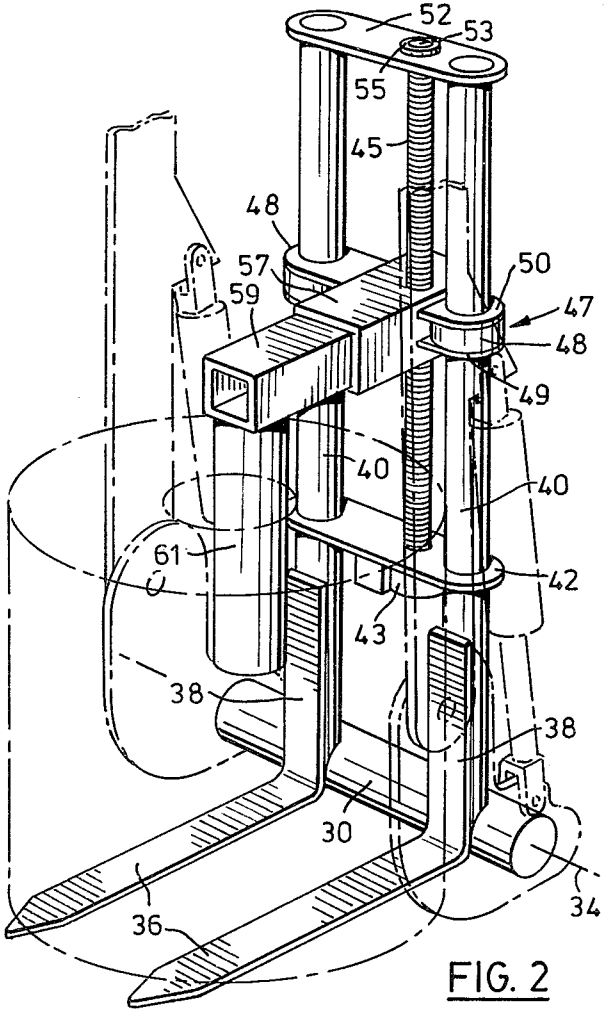
FIG. 2 is a perspective view of the remainder of the sub-frame of the apparatus of this invention.

Attention is now directed to FIG. 2, which illustrates the remaining structure which is fixed with respect to the pipe 30, and thus which will rotate along with the pivot plates 28 and the pipe 30.

In FIG. 2, only the pipe 30 is shown in solid lines. The pivot plates 28 are shown in broken lines, so as not to interfere with the illustration of the various parts to which FIG. 2 is directed.

Fixedly secured with respect to the pipe 30, as by welding or the like, are two spaced-apart parallel tines 36, each being pointed at its forward end 38. At the rearward end of each tine 36 is an upstanding abutment member 38, the purpose of which will become clear subsequently.

Extending upwardly to the rear of each abutment member 38 is a guide cylinder 40, the two guide cylinders 40 being connected together at an intermediate position therealong by a horizontal plate 42 which is welded to each of the guide cylinders 40. Mounted below the plate 42 is a hydraulic motor 43 adapted to rotate a threaded screw 45 in either direction upon command. Mounted to slide vertically along the guide cylinders 40 is a carriage shown generally at numeral 47, which consists of two cylindrical sleeves 48 and two horizontal plates 49 and 50 which are spaced apart and enclose the sleeves 48 between them. The carriage 47 is adapted to move as a unit, and the upper limit of its travel is defined by a further horizontal plate 52 which connects the upper ends of the guide cylinders 40.

As can be seen in FIG. 2, the threaded screw 45 has an unthreaded portion 53 at its upper end, which passes through and is adapted to rotate freely within a bearing 55 which is mounted centrally in the horizontal plate 52.

The threaded screw 45 threadedly engages a portion of a horizontally disposed rectangular guide member 57 in which a rectangular shaft 59 reciprocates. At the forward or leftward end of the shaft 59 is mounted a holding arm 61 which extends downwardly and perpendicular to the shaft 59. The guide member 57 is fixed with respect to the carriage 47, and thus moves vertically along with the carriage 47, under the urging of the threaded screw 45.

A similar threaded screw is utilized to cause the shaft 59 to reciprocate horizontally within the guide member 57, thereby bringing the holding arm 61 closer to or further from the guide cylinders 40.

FIG. 4 shows a section through the member 57 and the shaft 59, showing the drive mechanism in greater detail. A plate 61' is welded or otherwise secured to the inner end of the shaft 59, the plate 61' supporting a nut 63 which is engaged by a threaded shaft 64 rotated through a coupling 66 by a hydraulic motor 68. The hydraulic motor 68 is mounted within the far end of the member 57. It will be appreciated that rotation of the threaded shaft 64 by the hydraulic motor 68 will either push or pull the nut 63, and with it the shaft 59. Bearing plates 70 are provided, to allow the shaft 59 to slide easily within the member 57.

FIG. 4 also shows a nut member 72 secured to the lower inside of the guide member 57, and engaged by the threaded screw 45. It will be understood that the threaded screw 45 and the threaded shaft 64 are laterally offset from one another, in order to avoid mechanical interference.

Attention is now directed to FIG. 3, for a description of the operation of the apparatus illustrated in FIGS. 1, 2 and 4.

In FIG. 3A, the apparatus is shown to the right of a coil 64 which is resting on a support 65. The tines 36 defining the fork arrangement shown in FIG. 2 are illustrated just to the right of the coil 64, and in a position to pass under the coil 64. It will be noted that the holding arm 61 is withdrawn upwardly and rightwardly with respect to the tines 36, leaving sufficient space for the tines 36 to pass fully under the coil 64 until the abutment members 38 come into contact with the coil 64, without any mechanical interference.

FIG. 3B shows the apparatus with the forks 36 fully inserted under the coil 64. The open center of the coil is shown at 66.

The next step in the procedure is to move the holding arm 61 leftwardly to the position shown in FIG. 3C, where it is aligned above the central opening 66.

Figure 3G:
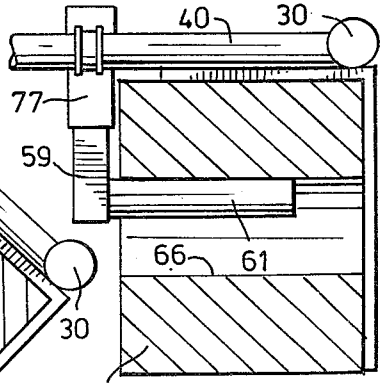
Figure 3F:
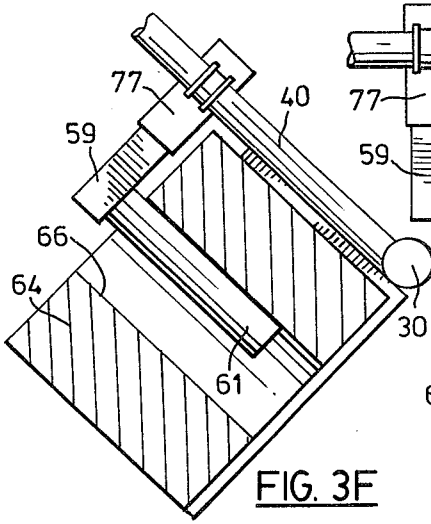
Figure 3E:
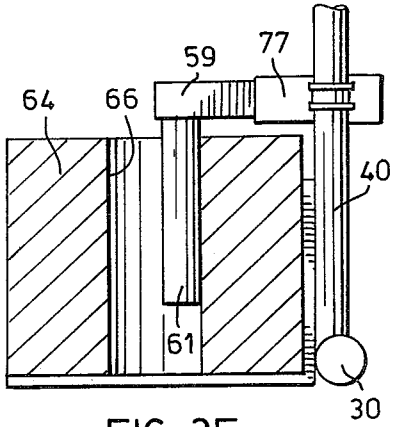
Figure 3J:
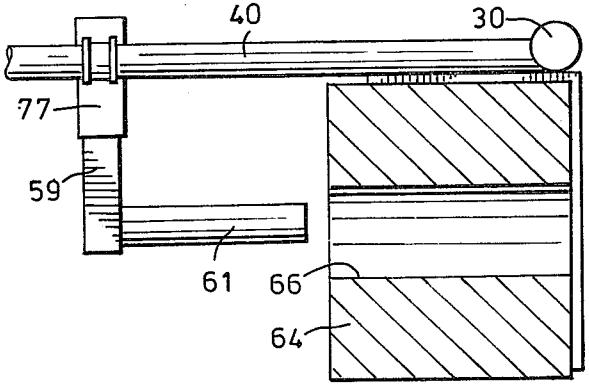
Figure 3D:
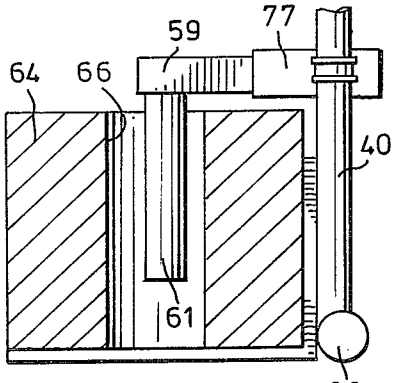

Looking now at FIG. 3D, it will be seen that the holding arm 61 has been moved downwardly into the open center of the coil 64, and in FIG. 3E, the holding arm 61 has been pulled rightwardly (rearwardly) against the innermost convolutions of the coil 64. This action holds the coil 64 between the holding arm 61 and the abutment members 38.

Now that the coil 64 is securely held by the apparatus, it is possible for the crane to raise the apparatus along with the coil 64 clear the ground. Once raised, the coil can be upended or rotated to 90° in a counter-clockwise sense as seen in FIG. 3 and as shown in FIG. 3F. This is done by causing the hydraulic cylinders 24 to retract, thus rotating the pivot plates 28 and the sub-frame shown in FIG. 2 in the counter-clockwise direction about the axis 34.

Figure 3H:
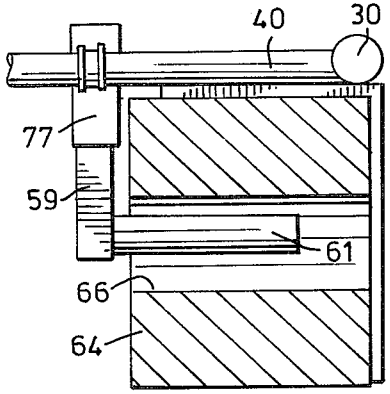

The coil 64 will then end up in the position shown in FIG. 3G, with its axis horizontal. Once in this position, the apparatus can set the coil 64 down against a suitable supporting surface and then the holding arm 61 can be lowered as shown in FIG. 3H and withdrawn as shown in FIG. 3J. The apparatus can then be lifted upwardly away from the coil 64 and used to perform a similar operation on another coil. Alternatively, the apparatus may simply transport the coil from one place to another, while the coil remains in an upright position in which its axis is vertical. Alternatively, the apparatus can be used to grip and lift a coil having its axis horizontal, simply by reversing the last three steps of the process, so that they are in the order 3J, 3H and 3G.

It is advantageous to construct the apparatus in such a way the horizontal axis defined by the line 34 in FIG. 2 is substantially in alignment with the center of gravity of the combination of sub-frame and coil, when the coil is of average weight and size. This will reduce the work required of the cylinders 24 in order to positively pivot the sub-frame and coil about the horizontal axis 34. Naturally, there is considerable variation in coil weight and size, and therefore an exact coincidence of the axis 34 with the center of gravity of the combination will be rare. However, the displacement will typically be small enough that no excessive turning force is required of the cylinders 24.

It will be appreciated that, since the hydraulic drives of the two screws moving the holding arm 61 require a hydraulic power unit, the cylinders 24 can have a dual function. By adjusting the orifice at the exit ports, the rotation speed can be adjusted and the cylinders can be used to assist in rotation of lighter coils and/or returning the forks to the horizontal position after discharging the previously rotated coil.

The embodiments of the invention in which an exclusive property or privilege is claimed are defined as follows:

1. A coil upending and transporting apparatus comprising:

a main frame having means for allowing the frame to be suspended from a suspension device, a sub-frame pivoted to said main frame at a horizontal axis located below said means, power means for positively pivoting the sub-frame with respect to the main frame about said axis, the sub-frame including:

(a) support means for engagement under a coil whose axis is vertical, (b) an elongate holding mandrel disposed so as to be parallel with the axis of a coil at one end of which the support means is engaged, and (c) control means for moving said holding mandrel selectively (1) in the direction of its elongation, and (2) perpendicular to both its own elongation direction and the direction of said horizontal axis, the horizontal axis at which the sub-frame is pivoted to the main frame being substantially aligned with the centre of gravity of the sub-frame when carrying a coil of average weight and size, thereby reducing the work required of the power means to positively pivot the sub-frame and coil about said horizontal axis.

2. The apparatus claimed in claim 1, in which the support means includes two spaced-apart parallel tines thus defining a fork arrangement adapted to engage one end of a cylindrical coil.

3. The apparatus claimed in claim 1 or claim 2, in which the said main frame includes two vertical spaced-apart members joined by an upper linking member, the linking member having a central opening for engagement by an overhead supporting device.

4. The apparatus claimed in claim 1 or claim 2, in which said holding mandrel is supported on the end of a first member which is in telescoping engagement with a second member, the holding mandrel being perpendicular to the first and second members, said control means including first screw means for moving the second member toward and away from said support means, and second screw means for telescoping the first member with respect to the first member.

* * * * *